US005136491A

United States Patent [19]

Kano

[11] Patent Number: 5,136,491

[45] Date of Patent: Aug. 4, 1992

[54] REFLECTOR FOR A LAMP AND METHOD OF DETERMINING THE FORM OF A REFLECTOR

[76] Inventor: Tetsuhiro Kano, Untere Sandstrasse 30, 8600 Bamberg, Fed. Rep. of Germany

[21] Appl. No.: 536,423

[22] Filed: Jun. 12, 1990

[30] Foreign Application Priority Data

Jun. 13, 1989 [DE] Fed. Rep. of Germany ..... 3919334

[51] Int. Cl.[5] ..... F21V 7/00

[52] U.S. Cl. ..... 362/346; 362/347; 362/350; 362/298; 359/900

[58] Field of Search ..... 362/346, 347, 341, 296, 362/297, 298, 350; 350/320; 359/900

[56] References Cited

U.S. PATENT DOCUMENTS

| | | | |
|---|---|---|---|
| 3,398,272 | 8/1968 | Elmer et al. . | |
| 4,356,538 | 10/1982 | Plummer | 362/3 |
| 4,420,801 | 12/1983 | Reiling et al. | 362/346 |
| 4,481,563 | 11/1984 | Snyder et al. | 362/346 |
| 4,612,608 | 9/1986 | Peitz | 362/346 |
| 4,616,294 | 10/1986 | Tenmyo | 362/350 |
| 4,730,240 | 3/1988 | van Meel et al. | 362/346 |
| 4,731,713 | 3/1988 | Perthus | 362/346 |
| 4,924,359 | 5/1990 | Lindae et al. | 362/346 |

FOREIGN PATENT DOCUMENTS

| | | | |
|---|---|---|---|
| 0402740 | 12/1990 | European Pat. Off. | 362/347 |
| 217720 | 7/1907 | Fed. Rep. of Germany . | |
| 1146825 | 4/1963 | Fed. Rep. of Germany | 362/350 |
| 1470102 | 2/1967 | France . | |
| 121919 | 7/1926 | Switzerland . | |
| 454131 | 9/1936 | United Kingdom . | |

*Primary Examiner*—Ira S. Lazarus
*Assistant Examiner*—D. M. Cox
*Attorney, Agent, or Firm*—Michael N. Meller

[57] ABSTRACT

A reflector for a lamp has a form which in a section containing the optical axis 1 lies between two curves enveloping the reflector section curve R. The enveloping curves may be two ellipses, two parabolas or an ellipse and a parabola.

18 Claims, 5 Drawing Sheets

REFLECTOR FOR A LAMP AND METHOD OF DETERMINING THE FORM OF A REFLECTOR

The invention relates to a reflector for a lamp or light and a method of determining the form of such a reflector.

The lamps in question here are intended in particular for lighting a room, illuminating an object or also for coupling light into an optical waveguide.

As reflector forms, in the prior art conic generation curves are known, i.e. an ellipse, a parabola, a hyperbola, a circle and straight lines (the latter as so-called singular conic sections). These reflector generating curves results in planar section figures which contain the optical axis of the reflector.

The foregoing known reflector generating curves have the following parameters and reflection properties:

a) Ellipse

The ellipse is, defined by two parameters, that is the major semiaxis a and the minor semiaxis b. Rays eminating from a focal point of the ellipse are reflected by the ellipsoid reflector so that they are condensed at the other focal point, the rays thereafter being propagated with a relatively large angle.

b) Parabola

The parabola is defined by one parameter (usually denoted "p"). Rays emanating from the focal point of the paraboloid are reflected by the reflector in such a manner that they run parallel to the optical axis.

c) Hyperbola

The hyperbola is defined by two parameters, the real semiaxis a and the imaginary semiaxis b. Rays emanating from the focal point are reflected so that they move away from the optical axis. The spreading of the rays is a function of the distance from the optical axis; the nearer the ray to the optical axis the more acute the angle relative to the optical axis.

d) Circle

The circle is, defined by one parameter, that is the radius r. Rays emanating from the center point of the circle are reflected so that they are condensed again at the center point.

e) Straight line

The straight line is defined by the so-called direction factor m. The optical properties of a straight-line reflector are trivial.

The reflection properties described above of conic section reflectors cannot fundamentally be changed even by varying said parameters.

In general, the designer of a certain reflector must follow marginal conditions according to which the lamp or light must be designed; for example, the light exit diameter and the length of the lamp may be predefined due to constructional conditions, as may the desired light distribution at a certain distance from the lamp.

Conventional reflectors with conic generating curves compel the designer to make considerable compromises when the marginal conditions are narrowly set. For given marginal conditions, reflectors with conic generating curves only rarely permit an optimum configuration of the lamp as regards the desired light distribution. With curve types having two parameters, such as the ellipse and hyperbola, only the focal point can be varied, although restrictions are imposed by the light source used.

If the marginal conditions (parameters) and the focal point are fixed, the form of the reflector curve is, also defined.

It is for example possible to form with a parabolic reflector a small light spot. The size of the light spot can then only be changed by changing the size of the reflector as a whole.

Elliptical reflectors are frequently used to illuminate a relatively large space area. However, the light distribution within the irradiating angle is very inhomogeneous and decreases greatly outwardly with increasing distance from the optical axis.

It is known to prepare the microstructure of the reflection surface, by roughening, hammering or sand blasting, to make the radiation more homogeneous, i.e. the light intensity is reduced in the center and increased at the edge. However, this method has disadvantages insofar as the width of the scattered light cannot be theoretically calculated in the design of the lamp but experimental values and tests are required. A further disadvantage of this method resides in that the scattered light also occurs far outside the radiation angle and the delimitation of the light spot is therefore not clear. Also, with the known methods of homogenizing the light distribution the efficiency of the lamp is relatively small, i.e. a relatively large energy consumption has to be accepted in order to achieve a specific predetermined brightness. The results as regards the uniformity of the light distribution within the radiation angle are also in need of improvement.

U.S. Pat. No. 3,390,262 discloses a reflector in which only a reflector portion close to the edge corresponds to a conic section whereas an inner reflector portion is of different design. The transition between the two said reflector portions is not gradual. This design has disadvantages in the reflector manufacture as regards the tooling. At the discontinuity, the reflector cannot be exactly formed in accordance with the tooling and as a rule scattered light results. A loss of energy must be expected. Also, with this known solution the uniformity of the light distribution cannot be achieved to the desired extent.

U.S. Pat. No. 3,507,143 discloses a lamp having a reflector consisting of segments which are so arranged that each segment reflects radiation emanating from a different area of the light source so that points on an area to be illuminated receive rays reflected by several different segments.

The problem underlying the invention is to show a possibility of designing reflector forms with which desired light distributions can be generated as required with high efficiency. Preparation of the microstructure of the reflection surface (as explained above) should be unnecessary and the reflector is also should not have any seams where different curves join.

The two curves between which the reflector according to the invention extends may, for example, be two different ellipses (i.e. ellipses with at least one different parameter), two different parabolas (i.e. parabolas with different parameters) or also an ellipse and a parabola The reflector form according to the invention is thus characterized in the latter example in that it is neither a pure ellipse nor a pure parabola but represents continuously, i.e. over its entire extent, a "hybrid" between such conventional known reflector forms. The reflector form according to the invention does not correspond to a conic section.

The reflection properties of reflectors designed according to the invention are fundamentally different from the reflection properties of conic section reflectors and as a rule also do not respond to simple "mean values" of the reflection properties of reflectors corresponding to the enveloping curves. In other words, the light distributions achieved according to the invention are not necessarily always a "hybrid" between the properties of the two enveloping curves used. This is true in particular when the two enveloping curves are different conic generating curves, such as a parabola and an ellipse.

The invention not only proposes certain reflector forms but also provides the lamp designer with a method enabling him to design an optimum reflector form in dependence upon the given marginal conditions for the lamp and the desired light distribution, the latter being achievable largely without using additional optical aids such as lenses, etc.

With the teaching according to the invention reflector forms can be designed with which radiation from a light source can be coupled in optimum manner into a radiation guide. Conventional purely ellipsoidal reflectors generate relatively large angles of incidence between the radiation to be coupled in and the optical waveguide. A reflector according to the invention however permits a relatively small angle of incidence between the radiation to be coupled in and the optical waveguide, the conduction of the radiation through the optical waveguide, for example, glass fiber, thereby being improved.

With the teaching according to the invention it is likewise possible to obtain a reflector which for a given distance, for example, 1 meter, can condense the radiation with high efficiency onto a specific point. The condensing is better than that achieved with a paraboloidal reflector.

Compared with ellipsoidal reflectors provided in the prior art for large radiation angles, a reflector designed according to the invention permits a relatively uniform light distribution.

Hereinafter, the preferred embodiment of the invention will be explained in detail with the aid of the drawings, wherein:

FIG. 1 shows schematically a section through a first preferred embodiment of a reflector;

FIG. 1' shows a variation of the first preferred embodiment of a reflector according to the invention where the focal points do not coincide;

FIG. 2 shows a section through a second preferred of embodiment of a reflector according to the invention;

FIG. 2' shows a variation of the second preferred embodiment of a reflector according to the invention where the focal points do not coincide;

Figure 1:
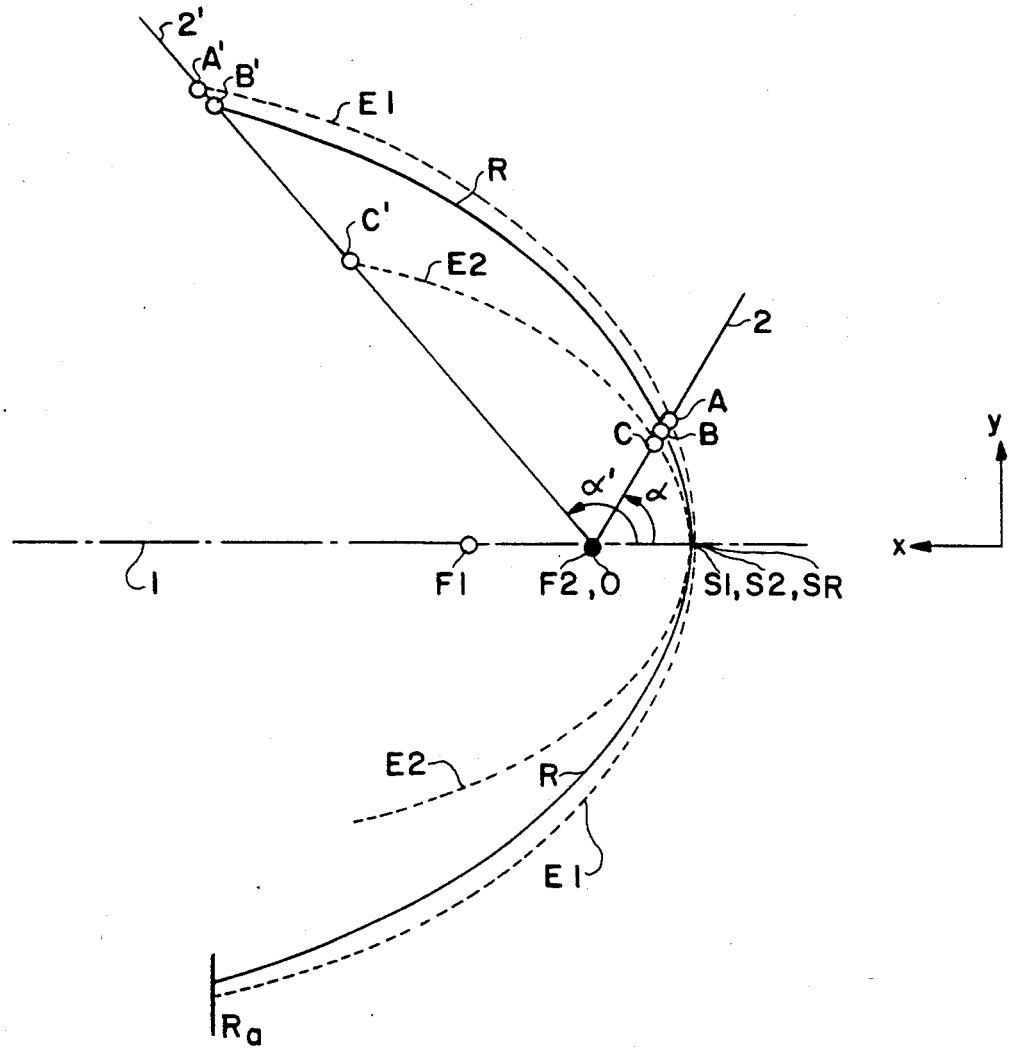

In the example illustrated in FIG. 1 the optical axis is denoted by the reference numeral 1. The reflector generating curve R according to the invention is shown in full line. The entire reflector is formed either by rotation of the curve R about the optical axis 1 or by translational displacement of the curve R when a channel-shaped reflector is to be made.

The form of the reflector generating curve R is configured so that in a manner described in detail below it lies between two enclosing (enveloping) curves which in the preferred of embodiment illustrated in FIG. 1 are an outer ellipse $E_1$ and an inner ellipse $E_2$. The ellipses $E_1$ and $E_2$ differ in at least one parameter (a and/or b).

The use of the two ellipses according to FIG. 1 as envelopes for the reflector generating curve R permits a reflector form whereby radiation can be coupled in optimum manner into an optical waveguide, i.e. the coupled-in radiation has a relatively small angle of incidence. For this purpose the two ellipses $E_1$, $E_2$ and the reflector generating curve R have a common optical axis 1. Two focal points $F_1$, $F_2$ coincide. A fixed point O also lies at the location of the focal points $F_1$, $F_2$. The fixed point O defines a polar angle and a distance ratio explained in detail below.

The reflector thus formed is not an ellipsoid.

As is apparent from FIG. 1, the reflector generating curve R extends in the vicinity of the vertex substantially closer to the inner ellipse $E_2$ than with increasing proximity to the edge $R_a$ of the reflector. This will be explained in detail below with the aid of the "distance ratio".

The preferred embodiment illustrated in FIG. 1 can be modified in that instead of the two ellipses, two parabolas are placed adjacent each other as enveloping curves for the reflector generating curve R. To enable a pronounced condensing of the radiation at a given distance from the lamp to be achieved with a reflector designed in this manner, the reflector form (the converse to the preferred embodiment according to FIG. 1 described above) near the vertex (i.e. on the optical axis) lies closer to the outer parabola (not shown) than to the inner parabola (not shown). With increasing proximity to the edge of the lamp the reflector section curve R then approaches the inner parabola. The reflector is not a paraboloid.

With the reflector form described above having two parabolas as envelopes a lamp is produced wherein the radiation is not directed exactly parallel to the optical axis but is reflected somewhat inwardly. Thus, without using a lens it is possible to generate at a given distance from the lamp a light spot having a diameter which is less than the aperture diameter of the lamp.

In the preferred embodiment illustrated in FIG. 1 the path of the reflector generating curve R between its two enveloping ellipses $E_1$, $E_2$ is described by means of a beam 2 emanating from a fixed point O coinciding with the focal points $F_1$, $F_2$ and the polar angle $\alpha$ generated by said beam. The beam 2 intersects the ellipses $E_1$, $E_2$and the reflector generating curve R. The intersections are provided with the reference letters A, B and C respectively. In FIG. 1, two positions of the moving beam 2, 2' are shown and in the second position the corresponding reference letters are denoted by a dash.

A distance ratio k may now be defined as follows:

$$k=(b-c)/(a-c),$$

wherein a is the distance between the points A and O, b the distance between the points B and O and c the distance between the points C and O.

In the preferred of embodiment according to FIG. 1 the distance ratio k in the region of the vertices $S_1$, $S_2$ and $S_R$ of the curves $E_1$, $E_2$ and R respectively is relatively small, i.e. the vertex $S_R$ of the reflector R lies closer to the vertex $S_2$ of the inner enveloping ellipse $E_2$ than to the vertex $S_1$of the outer enveloping ellipse $E_1$.

With increasingly large polar angle $\alpha$ the distance ratio changes so that near the edge $R_a$ of the reflector the latter lies closer to its outer enveloping ellipse $E_1$ than to its inner enveloping ellipse $E_2$.

Analytically, the variation of the distance ratio can be represented as a function of the polar angle $\alpha$ by the following equations:

$$k=U\times(\alpha/\alpha_{max})^y+V \quad (1)$$

$$k=U\times\log \alpha/\alpha_{max}+V \quad 2)$$

$$k=U\times e^{\alpha/\alpha_{max}}+V \quad (3)$$

wherein $\alpha_{max}$ represents the largest polar angle of the moving beam 2 (i.e. corresponding substantially to the beam 2' in FIG. 1), i.e. the angle of the beam grazing the edge $R_a$ of the reflector generating curve R. In equations (1), (2) and (3) y denotes a real number, in particular 1, and U and V also each denote real numbers.

The reflector should not have any discontinuities, i.e. the change of the distance ratio as a function of the polar angle $\alpha$ should follow a smooth function. Preferably, the reflector has a smoothly differentiable form. This also applies to the preferred embodiment of a reflector according to the invention shown in FIG. 2.

Above, the design of a reflector according to the invention has been described using polar coordinates. Polar coordinates have here certain advantages but it is also possible to use cartisian or other coordinates.

Figure 2:
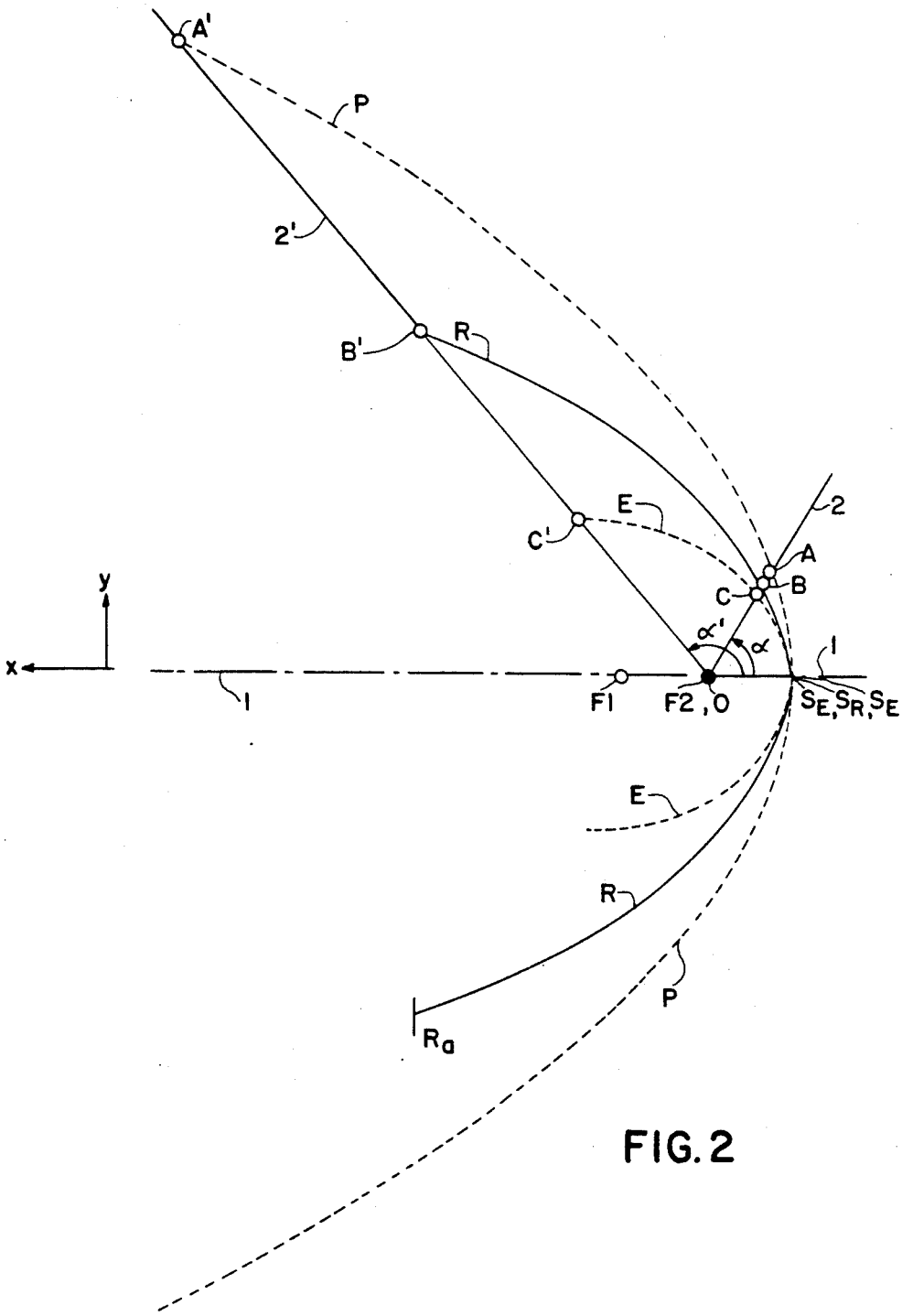

The reflector R shown in FIG. 2 serves to generate a uniform-like distribution. An ellipse E and a parabola P are placed adjacent each other in such a manner that the focal point $F_1$ of the parabola coincides with a focal point $F_2$ of the ellipse E. The fixed point O defining the beam 2 and the polar angle $\alpha$ also lies at the two focal points on the optical axis 1.

In the preferred embodiment illustrated in FIG. 2 the distance ratio k of the reflector R as defined above between the enveloping curves E and P is constant.

By changing the distance ratio k the optical properties of the reflector R can be varied as required. The closer the distance ratio k is to unity the more similar the optical properties of the reflector R to those of a parabolic reflector.

The optical properties of the reflector R in the preferred embodiment according to FIG. 2 are governed by the parameters a, b of the ellipse E, the parameter p of the parabola P, the distance between the vertices $S_E$ and $S_P$of the ellipse E and the parabola P on the optical axis 1 and the distance ratio k described above.

In a modification of the preferred embodiment described in FIG. 2 the distance ratio k may also vary as a function of the polar angle $\alpha$, in particular in accordance with the functions of equations (1), (2) and (3).

Also, the preferred embodiment according to FIG. 2 may be modified in that the focal points of the parabola and ellipse need not coincide. Also, the distance between the vertices $S_E$ and $S_P$ on the optical axis 1 may be reduced and in the extreme case the two vertices may coincide.

Figure 5:
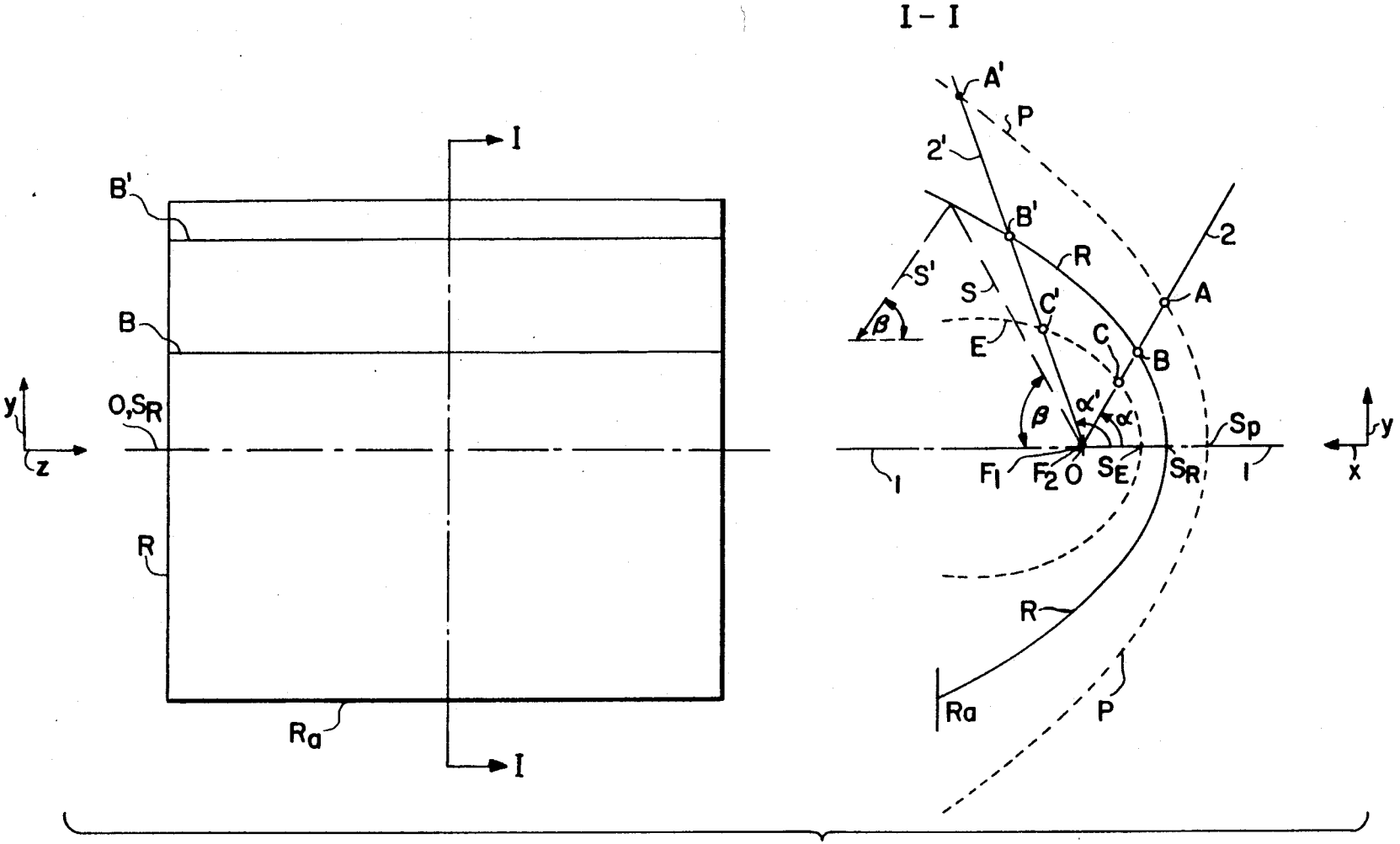
FIG. 5 shows an embodiment of the invention and front view of a reflector according to the invention.
Figure 6:
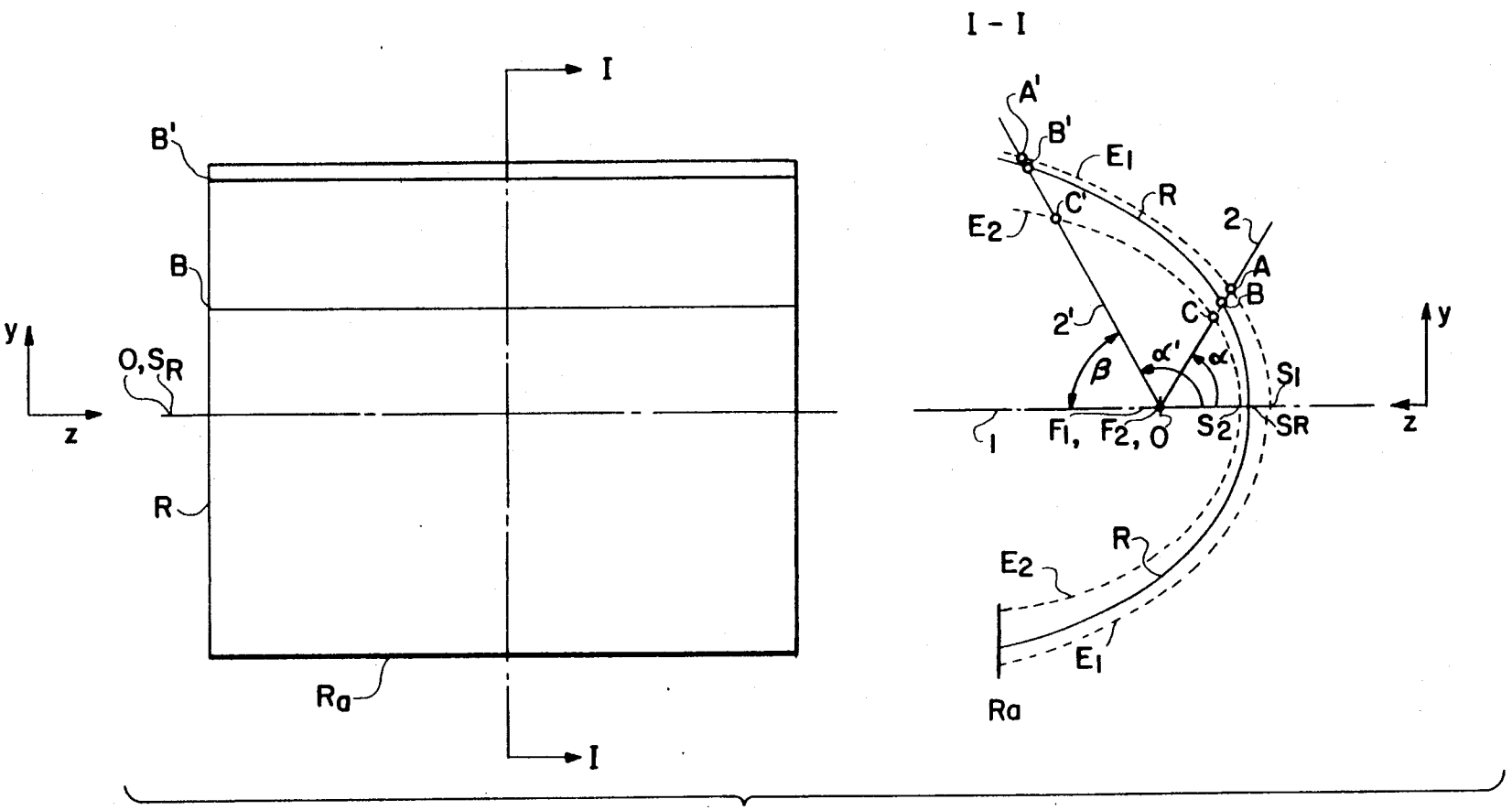
FIG. 6 shows an embodiment of the invention and front view of a reflector according to the invention.

FIGS. 1' and 2' show the embodiments of FIG. 1 and FIG. 2 with non-coincident focal points. FIGS. 5 and 6 show the embodiments of FIGS. 2 and 1 with a front view of channel-shaped reflectors.

It is also possible in a modification of the preferred embodiment of FIG. 2 to arrange the ellipse outside the parabola, i.e. to reverse the size relationship of of parabola and ellipse.

Furthermore, the preferred embodiments according to FIGS. 1 and 2 may be modified in that the optical axes of the enveloping curves $E_1$, $E_2$, E, P need not coincide. The optical axis of an enveloping curve may be slightly inclined with respect to the optical axis of the other enveloping curve.

The preferred embodiments described above of curves such as $E_1$, $E_2$, E, P enveloping the reflector form may be described by equations $$ax^2+bxy+cy^2+bx+ey+f=0$$

wherein a, b, c, d, e and f are constants and x and y are variables.

The light distribution of a reflector according to the invention can be determined theoretically as well as empirically. A theoretical calculation is simple in particular when an analytic expression is given for the distance ratio or the path of the curve R so that the tangent can be calculated by differentiation. From the tangents at a plurality of points each selected with constant angular intervals apart on the reflector generating curve R, from the law of reflection ("angle of incidence=angle of reflection") the directions of the rays leaving the lamp can be determined and from this the intensity distribution at a given distance from the lamp is obtained, i.e. the number of light rays arriving per unit area.

To obtain a single homogeneously illuminated light spot on a wall remote from the lamp with a reflector R according to FIG. 2 without using aids (caps or the like), the light ray S reaching the aperture edge $R_a$ of the reflector R forms with the optical axis 1 an angle $\beta$ which is equal to the angle $\beta'$ which the light ray S'. reflected at the edge forms with the optical axis. In this case the direct radiation from the light source at the location O and the reflected radiation form identical light cones.

The light source need not necessarily be arranged at the focal points $F_1$, $F_2$ or at the location 0.

Figure 3:
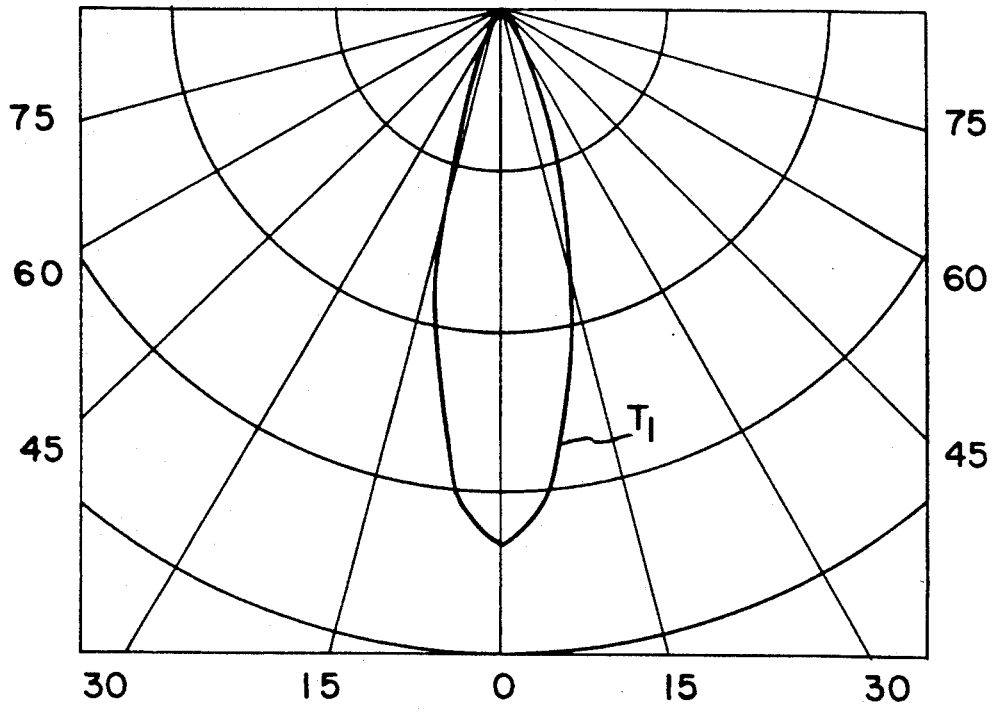
FIG.3 PRIOR ART
FIG. 3 shows a light intensity distribution of a lamp having a conventional ellipsoidal reflector.
Figure 4:
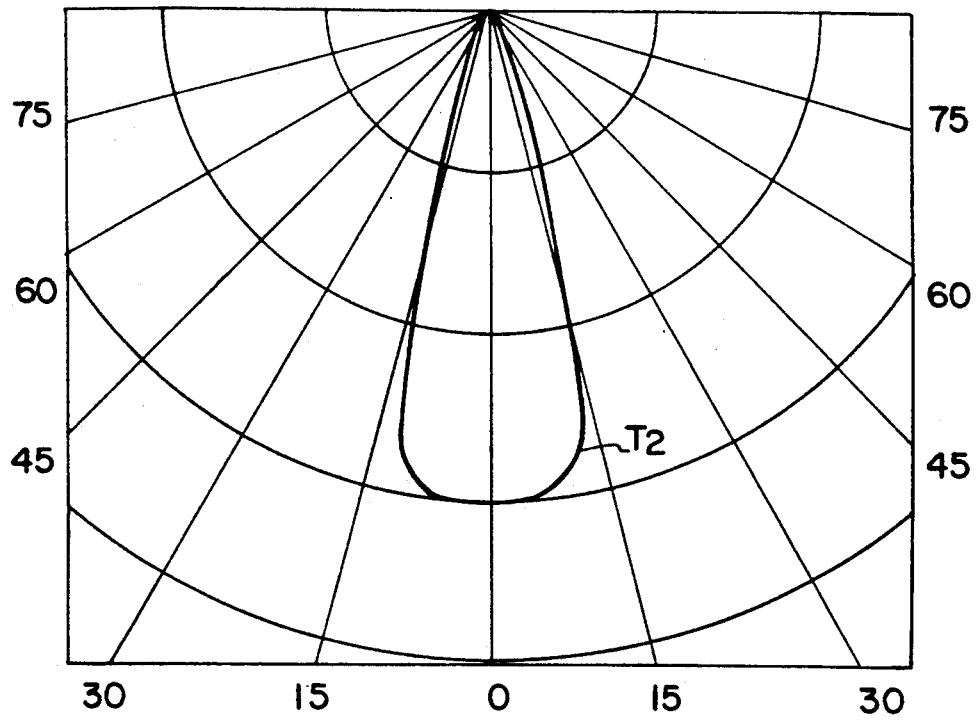
FIG. 4 shows a light intensity distribution of a lamp with a reflector of the invention according to FIG. 2.

FIGS. 3 and 4 show a comparison of the light intensity distribution in a conventional lamp having an ellipsoid reflector and in a lamp according to the invention as shown in FIG. 2. In FIG. 3 the light intensity distribution $I_1$of a lamp with conventional ellipsoid reflector is plotted as a function of the exit angle in the usual manner. The curve $I_1$ shows that the brightness decreases greatly towards the side starting from a maximum at 0°.

In contrast, in a reflector according to the invention the light intensity distribution $I_2$ in accordance with FIG. 4 is substantially more uniform and remains almost constant within a predetermined angle. The reflector generating the light distribution according to FIG. 4 is designed in the manner described above with two conic section curves, that is a parabola with p=39.0, an ellipse with a=90.2 and b=56.0 and a distance ratio k of 0.22 (constant).

It is possible to provide a reflector surface according to the invention with facets in order to avoid any aesthetically disturbing phenomenon of bright and dark rings in the light spot with certain light sources having a coiled filament.

In particular with a channel-like reflector the form need not necessarily be symmetrical with respect to the central longitudinal plane of the reflector. On the contrary, the lower part of the reflector may differ from the upper part to obtain an optimum adaptation to the required illumination.

I claim:

1. A reflector for a lamp which is formed as a portion of a solid revolution, the generatrix of the solid of revolution being formed by a generating curve which is not of conic form and which does not comprise conic sections, wherein said generating curve lies between two enveloping curves which are of conic section type, wherein a distance ratio k at any point on said generating curve with respect to said enveloping curves varies in dependence upon the distance of said point from the vertex of said generating curve.

2. A reflector according to claim 1, wherein the two enveloping curves are of the same conic section type.

3. The reflector according to claim 1, wherein the two enveloping curves are of different conic section type.

4. The reflector according to claim 1, wherein the focal points of the two enveloping curves coincide.

5. The reflector according to claim 1, wherein the vertices of the two enveloping curves lie on each other.

6. The reflector according to claim 1, wherein the vertices of the two enveloping curves are spaced apart.

7. The reflector according to claim 1, wherein the base angles of a triangle formed by a light beam incident on the reflector edge and the light beam associated therewith reflected at the reflector edge and the optical axis are equal.

8. The reflector according to claim 1, wherein the generating curve is smoothly differentiable.

9. A reflector for a lamp which is formed as a portion of a solid of revolution, the generatrix of the solid of revolution being formed by a generating curve which is not of conic form and which does not comprise conic sections, wherein said generating curve lies between two enveloping curves which are of different conic section type and where the distance ratio k at any point on said generating curve with respect to said enveloping curves is constant.

10. The reflector according to claim 9, wherein the focal points of the two enveloping curves coincide.

11. The reflector according to claim 9, wherein the vertices of the two enveloping curves lie on each other.

12. The reflector according to claim 9, wherein the vertices of the two enveloping curves are spaced apart.

13. The reflector according to claim 9, wherein the base angles of a triangle formed by a light beam incident on the reflector edge and the light beam associated therewith reflected at the reflector edge and the optical axis are equal.

14. The reflector according to claim 9, wherein the generating curve is smoothly differentiable.

15. A reflector for a lamp which is channel shaped, the generatrix of said channel-shape being formed by a generating curve which is not of conic form and which does not comprise conic sections, wherein said generating curve lies between two enveloping curves which are of conic section type, wherein a distance ratio k at any point on said generating curve with respect to said enveloping curves varies in dependence upon the radial distance of said point from the vertex of said generating curve.

16. The reflector according to claim 15, wherein the two enveloping curves are of the same conic section type.

17. The reflector according to claim 15, wherein the two enveloping curves are of different conic section type.

18. The reflector according to claim 15, wherein said generating curve lies between two enveloping curves which are of different conic section type and where the distance ratio k at any point on said generating curve with respect to said enveloping curves is constant.

* * * * *